US007780460B2

(12) United States Patent
Walter

(10) Patent No.: US 7,780,460 B2
(45) Date of Patent: Aug. 24, 2010

(54) CONNECTING TERMINAL

(75) Inventor: Frank Walter, Blumberg (DE)

(73) Assignee: MC Technology GmbH, Blumberg (DE)

( * ) Notice: Subject to any disclaimer, the term of this patent is extended or adjusted under 35 U.S.C. 154(b) by 0 days.

(21) Appl. No.: 12/232,057

(22) Filed: Sep. 10, 2008

(65) Prior Publication Data

US 2009/0068863 A1 Mar. 12, 2009

(30) Foreign Application Priority Data

Sep. 11, 2007 (DE) ..... 10 2007 043 197

(51) Int. Cl.
*H01R 12/00* (2006.01)

(52) U.S. Cl. ..... 439/81

(58) Field of Classification Search ..... 439/436–441, 439/835, 266, 268, 709, 267, 736
See application file for complete search history.

(56) References Cited

U.S. PATENT DOCUMENTS 5,494,456 A * 2/1996 Kozel et al. ..... 439/441
6,074,242 A 6/2000 Stefaniu et al.
6,093,053 A 7/2000 Horioka et al.
6,712,641 B2 * 3/2004 Beege et al. ..... 439/441

FOREIGN PATENT DOCUMENTS

DE 33 20 418 A1 1/1984
DE 196 14 988 A1 10/1997

* cited by examiner

*Primary Examiner*—Edwin A Leon
(74) *Attorney, Agent, or Firm*—The Nath Law Group; Jerald L. Meyer; Robert T. Burns

(57) ABSTRACT

The invention relates to a connecting terminal with an insulating housing and a clamping contact positioned in the connecting terminal housing for the purpose of connecting an electrical conductor, such that a contact spring, which is electrically connected to the clamping contact in the housing, is guided through an initial hole in the housing of connecting terminal to the outside of the housing, and where the contact spring is so designed that it presses against the contact surface of the circuit board when the connecting terminal is mounted on a circuit board, to thereby produce an electrical contact between the circuit board and the clamping contact.

12 Claims, 11 Drawing Sheets

CONNECTING TERMINAL

Figure 1:
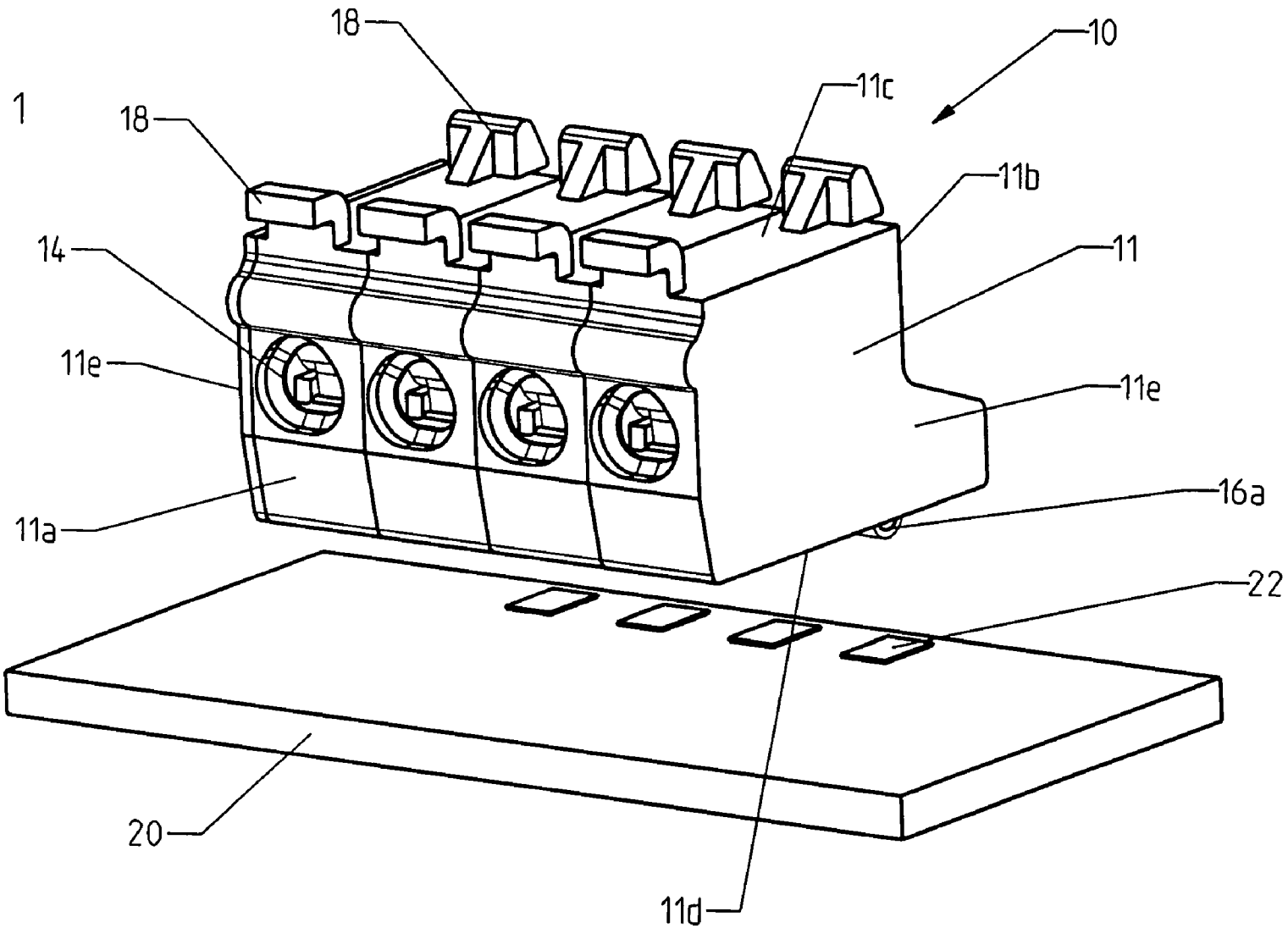

The invention relates to a connecting terminal in accordance with the preamble of patent claim 1.

Known to the prior art are connecting terminals that have an insulating housing, as well as a clamping contact that is positioned in the terminal housing for the purpose of connecting an electrical conductor. For example, this kind of connecting terminal is known from DE 44 20 984 A1. In order to produce a contact between the connecting terminal and a circuit board, multi-pin or prong connectors are usually employed, such that the prongs are applied to the circuit board using a perforation method and are connected to the circuit board, while the connecting terminals are attached to the corresponding prongs. An electrically conductive contact is then produced between an electrically conductive element positioned within the connecting terminal and the prong.

As an alternative, surface-mounted prongs are known, e.g., ones soldered to a contact surface belonging to the circuit board. Again, the connecting terminals are connected to the connecting terminal by means of a contact.

A disadvantage here rests in the fact that separate prongs are basically necessary in order to the produce the contact between the connecting terminals and the circuit boards. Moreover, there is a high assembly expense involved in securing the prongs to the circuit board, using either the perforation method or the SMD (surface-mounted device) method, and then applying the connecting terminals to the prongs.

The goal of the invention, therefore, is to provide a connecting terminal which produces the electrical contact with the circuit board in a simple manner.

This goal is achieved in a connecting terminal with the features of patent claim 1.

Advantageous embodiments and elaborations of invention are indicated in the secondary claims.

The invention is based on the basic idea of producing a direct contact between the connecting clip and a conductive contact area on the surface of the circuit board, instead of using a contact prong which is positioned on the circuit board, as in the prior art. To this end, the invention provides that a contact spring, which is electrically connected to the clamping contact of the connecting terminal inside the housing of connecting terminal, is led through an initial hole in the connecting terminal housing to the outside of the housing. The contact spring is so designed that it presses against a contact surface belonging to the circuit board when the connecting terminal is mounted on the circuit board, thereby producing an electrical contact between the circuit board and the clamping contact. Thus, separate contact prongs can be omitted completely. In this way, expense can be spared with respect to both the prongs and their mounting.

The contact spring will ideally be designed as a flat or blade spring, which can be very economically produced.

According to a particularly preferred embodiment of the invention, the unattached end of the flat spring is bent in shape, specifically, in a U-shape. By bending the free end of the flat spring in this way there is less friction between the flat spring and the contact surface of the circuit board than is the case when the free end of the flat spring rests against the contact surface of the circuit board. Moreover, a resting surface is guaranteed for different relative positions between the contact spring and the contact area, and with it a more secure electrical contact.

In a preferred embodiment of the invention the contact spring is connected to the clamping contact to form a single piece. This simplifies the manufacturing process for the contact spring and the clamping contact.

In an alternative embodiment of the invention the contact spring is connected to the clamping contact by means of riveting, welding, soldering, or compression, e.g., to permit the use of different materials in producing the contact spring and the clamping contact.

The clamping contact is designed for the simple attachment of an electrical conductor, and ideally takes the form of a screw contact or an elastic clamping contact.

According to a particularly preferred embodiment of the invention, the clamping contact has an actuating element for releasing the clamping contact. Here the actuating element is guided through a second hole in the housing of the connecting terminal, or is accessible through this hole. If the clamping contact is designed, e.g., as a screw contact, the actuating element will ideally take the form of a screw, which is accessible through the second hole in the housing of the connecting terminal and can therefore be detached at a later point in order to remove the electrical conductor. When the clamping contact takes the form of an elastic clamping contact, the actuating element may be designed, e.g., as a pressure element, which can counter the elastic force of the elastic clamping contact and open the clamping spring in such a way that the electrical conductor is released and can be removed from the connecting terminal. This pressure element will preferably be guided to the outside through the second hole in the housing of the connecting terminal, which makes it freely accessible and easy to actuate from the outside.

In an advantageous embodiment of the invention, the first hole and the second hole lie on the same side of the housing of the connecting terminal, to thereby insure a high degree of accessibility.

Ideally at least one connecting element will be positioned on the housing of the connecting terminal, specifically at least one snap-in element and/or at least one screw contact, in order to mount the connecting terminal on the circuit board and/or in the housing. A connecting element for mounting the connecting terminal on the circuit board and/or in the housing is preferred particularly because it allows the connecting terminals to be fixed in position on the circuit board and/or in the housing and, if so required, the pressure needed for creating the electrical contact between the contact area of the circuit board and the contact spring of the connecting terminal can be produced and insured on a long term basis, even in the case of movement of the circuit board and/or the housing.

The connecting terminal can be arranged plurally in a row, thereby saving space, while providing the connecting terminals needed for an electric or electronic device.

The connecting terminal according to the invention is put to use specifically in the form of a housing with a first and a second part, such that at least one connecting terminal according to the invention is positioned in the first part and a circuit board with at least one contact area is positioned in the second part. By joining together the first and second parts, the contact spring of the connecting clip is pressed against the corresponding contact area on the circuit board to produce an electrical contact. In this manner the electrically conductive contact is insured between the contact area and the connecting terminal upon assembly of the housing. At the same time, the connecting terminal and the circuit board are protected from outside influences.

The first and second parts of the housing are advantageously connected with a snap connector, which is particularly easy to produce and attach.

It is particularly preferred if a plurality of connecting terminals is positioned in the first part and a plurality of corresponding contact areas is positioned on the circuit board, in order to permit the simple provision and mounting of all connections necessary for an electrical device.

In order to assure a good contact between the contact area of the circuit board and the contact springs, the contact areas of the circuit board will ideally be coated with gold or tin.

The invention is next explained in detail on the basis of the following figures.

Figure 2:
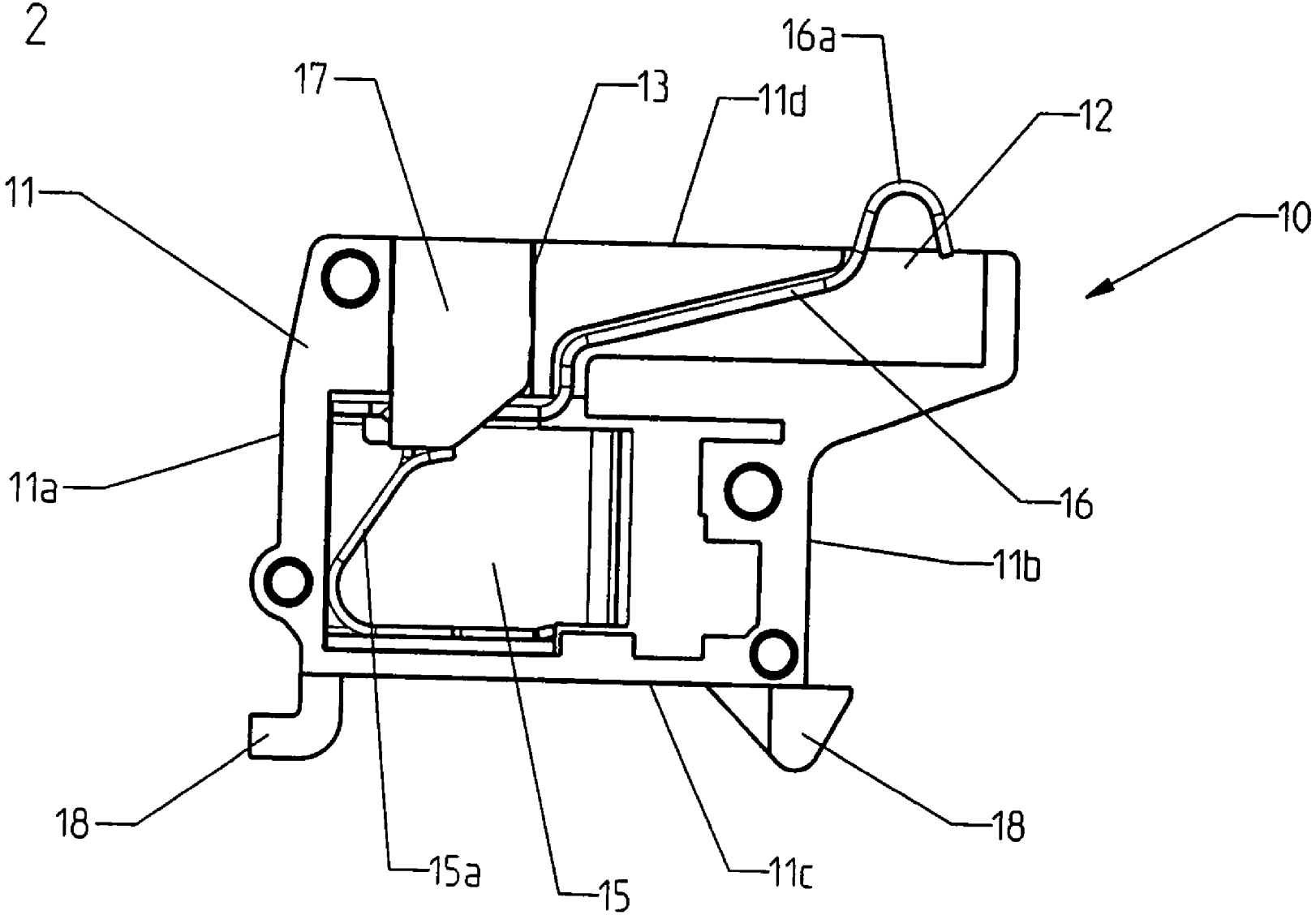

Shown are:

FIG. 1 a perspective view of an initial exemplary embodiment of the invention FIG. 2 a section through a connecting terminal of the exemplary embodiment shown in FIG. 1

Figure 3:
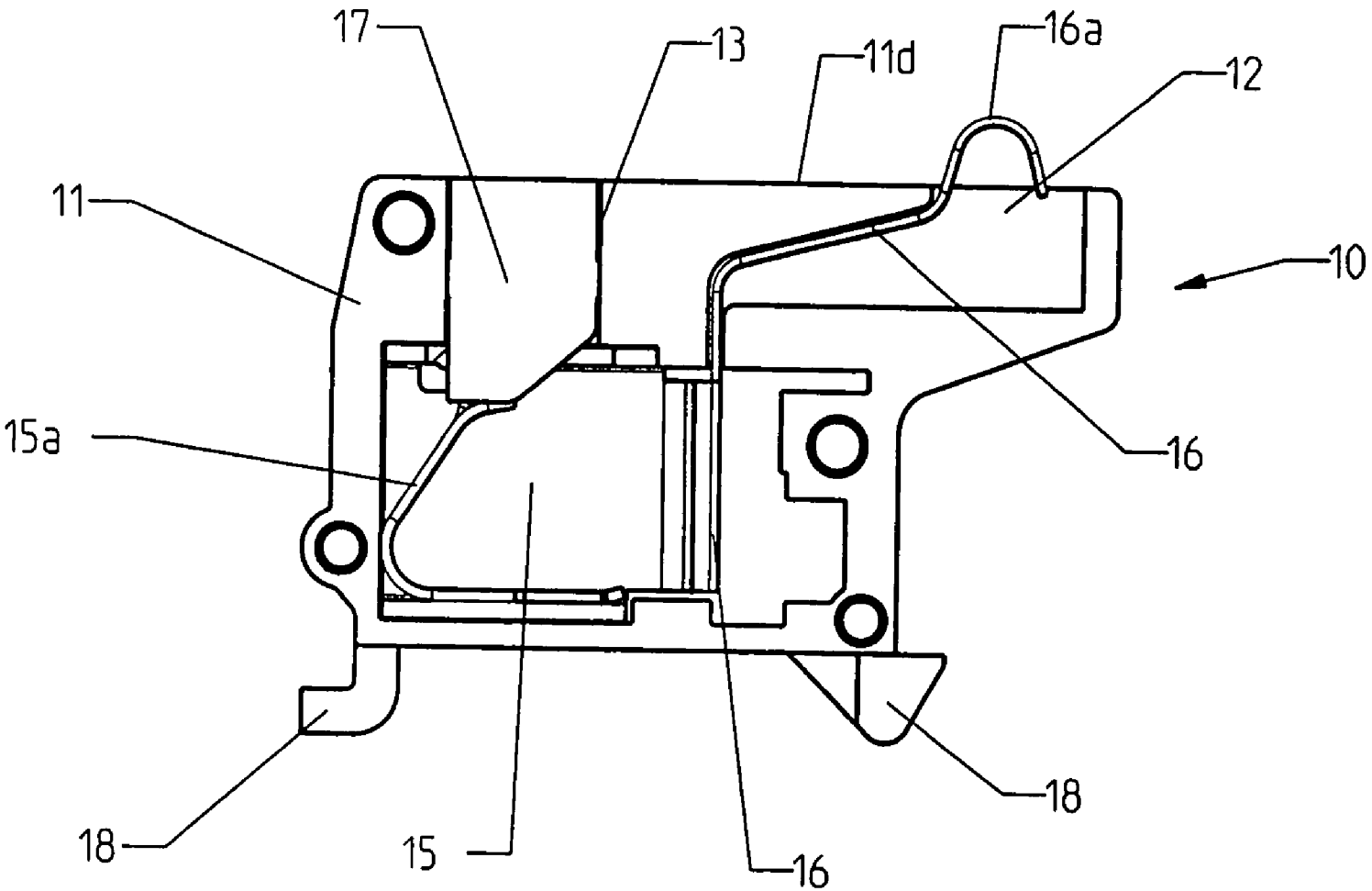

FIG. 3 a section through a second exemplary embodiment of the invention

Figure 4:
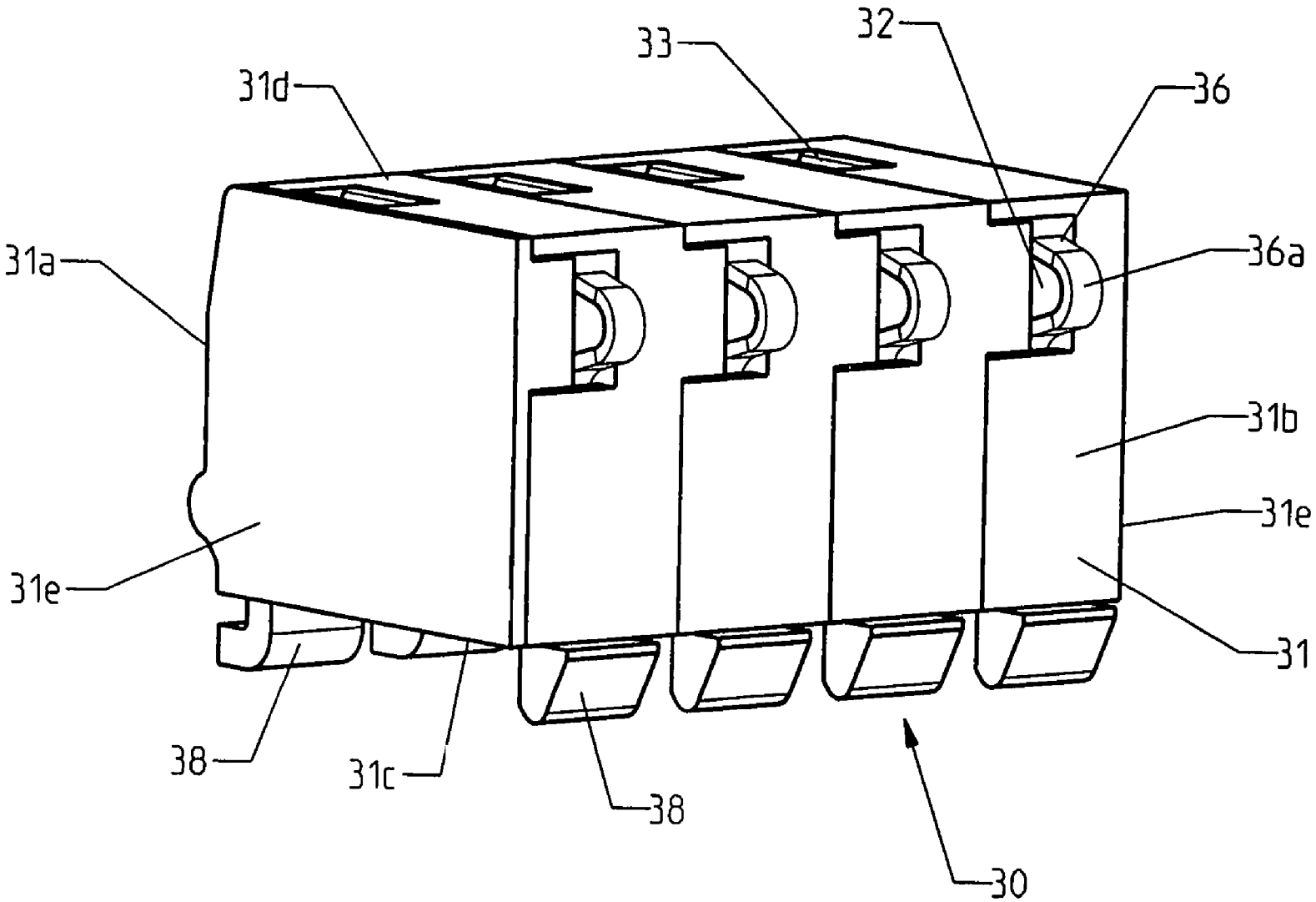

FIG. 4 a perspective view of a third exemplary embodiment of the invention

Figure 5:
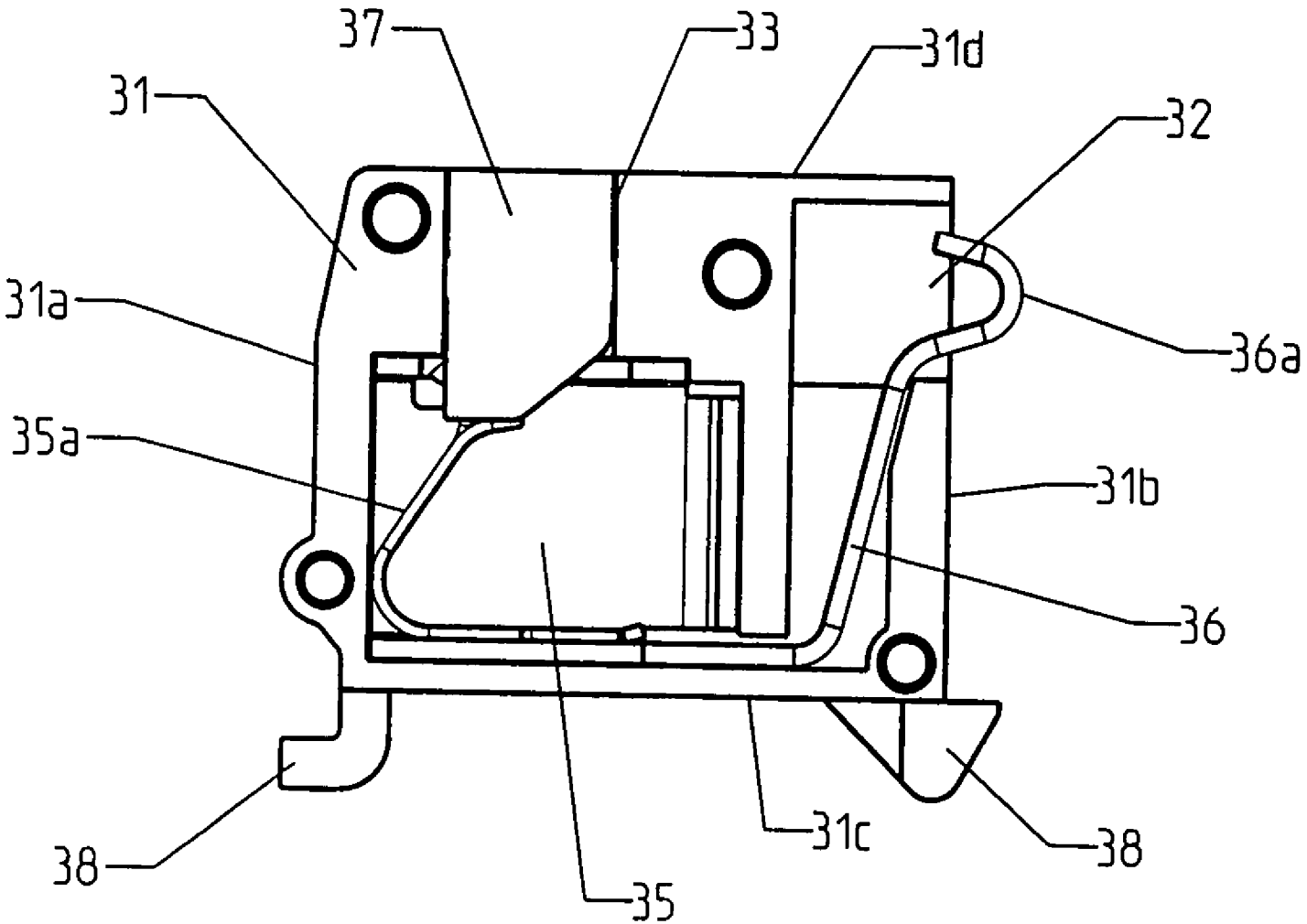

FIG. 5 a section through a connecting terminal of the exemplary embodiment shown in FIG. 4

Figure 6:
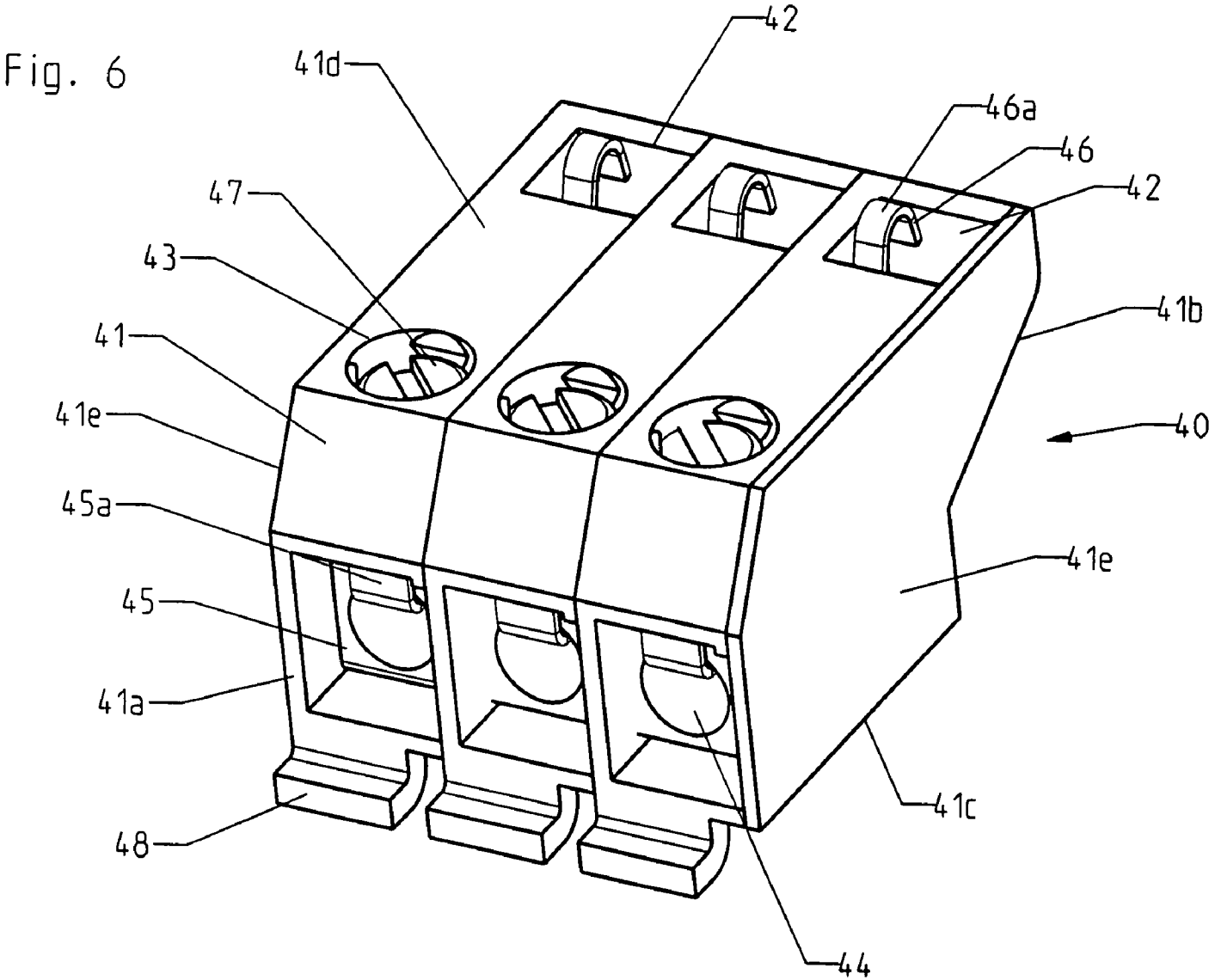

FIG. 6 a perspective view of a fourth exemplary embodiment of the invention

Figure 7:
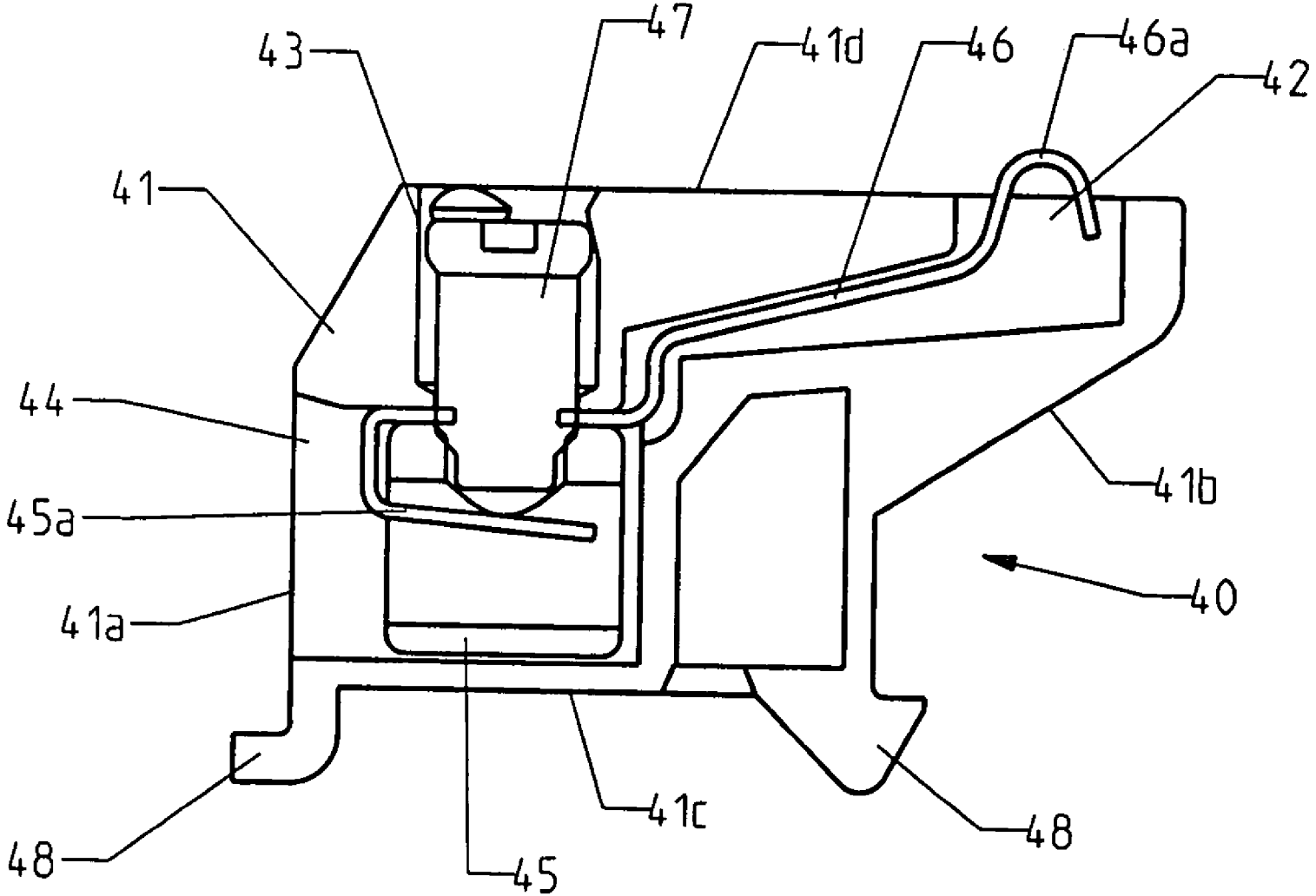

FIG. 7 a section through a connecting terminal of the exemplary embodiment shown in FIG. 6

Figure 8:
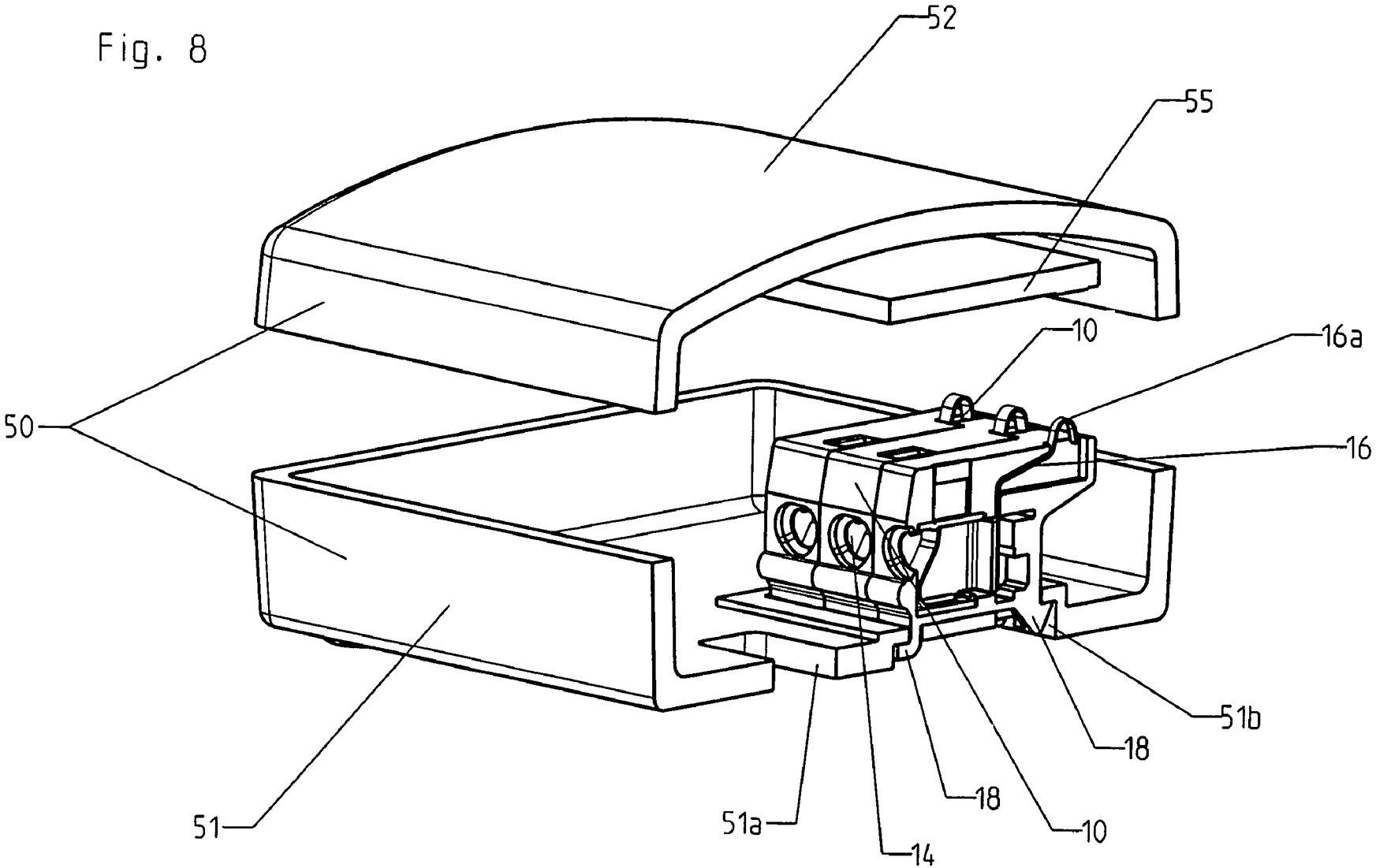
Figure 9:
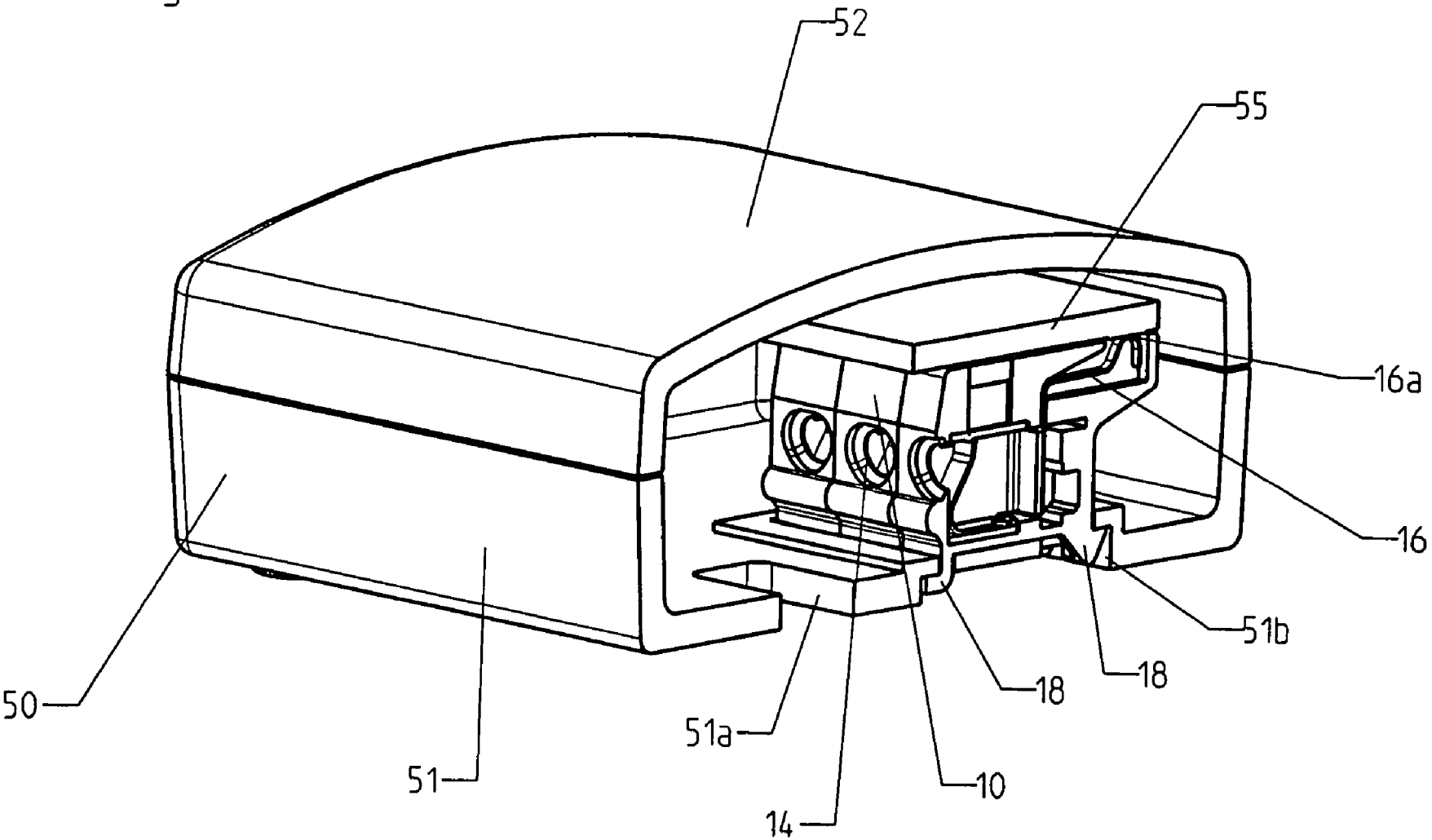
Figure 10:
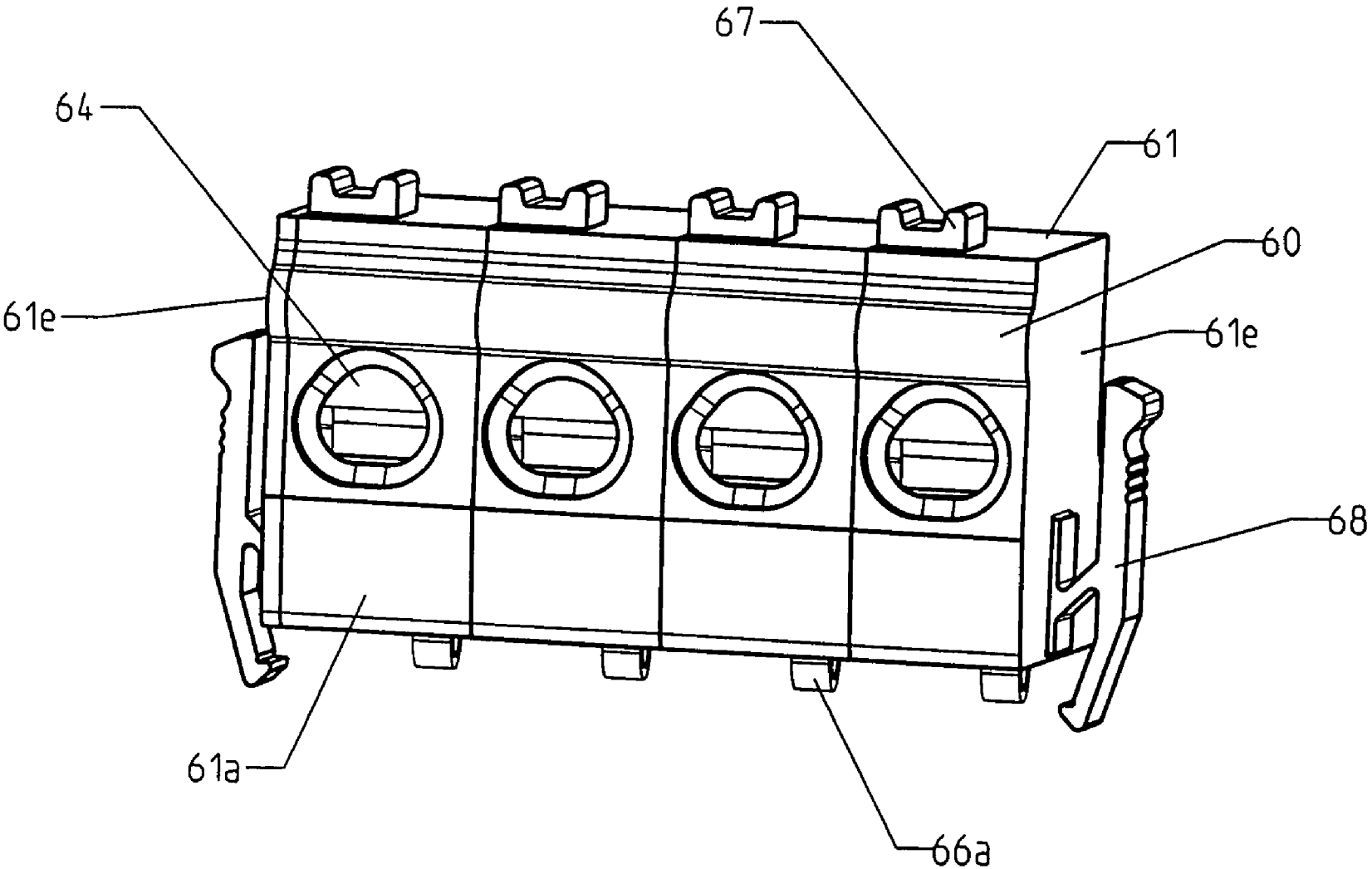
Figure 11:
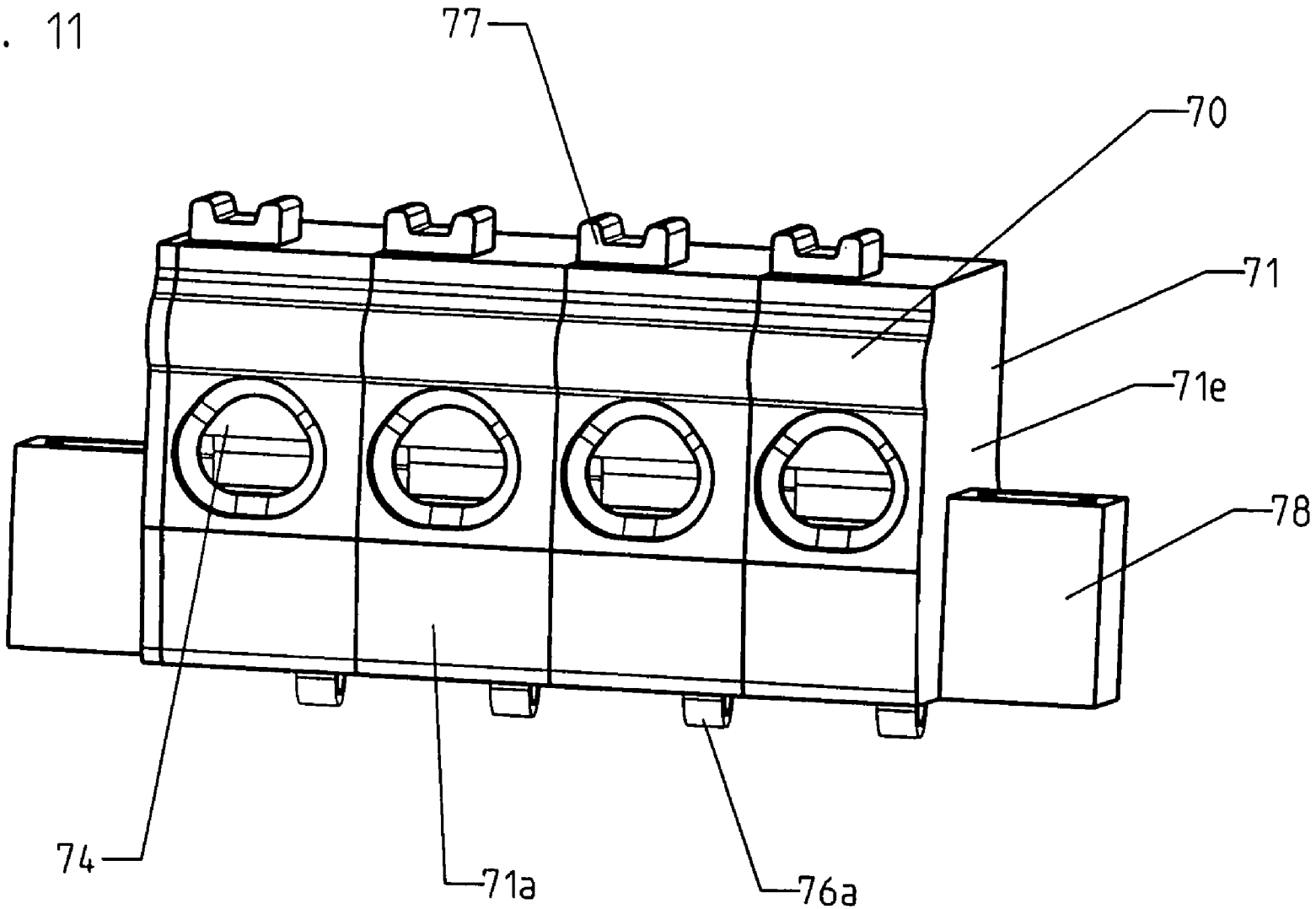

FIG. 8 a perspective view of a configuration of connecting terminals in accordance with FIG. 3, shown in a housing that is opened FIG. 9 the housing of FIG. 8 in assembled condition FIG. 10 a perspective view of a fifth exemplary embodiment of the invention FIG. 11 a perspective view of a sixth exemplary embodiment of the invention.

FIGS. 1 and 2 depict an initial exemplary embodiment of the invention. FIG. 1 shows four connecting terminals 10, each of which has a connecting terminal housing 11 with a front side 11*a*, a back side 11*b*, an upper side 11*c*, a lower side 11*d*, and two lateral areas 11*e*. The connecting terminals 10 are positioned side by side to form a row.

As can be seen from FIG. 2, the connecting terminal 10 has a clamping contact 15 with a clamping spring 15*a*. An electrical conductor (not shown) can be led through a third hole 14 which is located in the front side 11*a* of the housing 11 of the connecting terminal 10, as shown in FIG. 1, and guided into the interior of the housing 11. In the process, it presses the clamping spring 15*a* back against an elastic force, to a point such that the electrical conductor is fixed between the clamping spring 15*a* and the clamping contact 15.

A contact spring 16 is so positioned on the clamping contact 15 as to form a single piece with it and in such a way that the contact spring 16 is guided through an initial hole 12 positioned in the lower side 11*d* of the connecting terminal housing 11 and is guided on to the exterior of said housing 11. The contact spring 16 is designed as a flat spring and has a free or unattached end 16*a* that projects through the first hole 12 and away from the connecting terminal housing 11.

As can be seen in FIG. 1, when the connecting terminal 10 is placed on a circuit board 20, the free end 16*a* of the contact spring 16 comes into contact with the contact area 22 located on the circuit board 20. An electrically conductive contact is consequently produced between the contact spring 16, specifically its unattached end 16*a*, and the contact area 22 of the circuit board 20 simply by placing the connecting terminal 10 onto the circuit board 20. In order to reduce friction between the free end 16*a* of the contact spring 16 and the contact area 22 of the circuit board 20, the free end 16*a* of the contact spring 16 is bent, specifically in the shape of a U.

To guarantee a particularly good electrical contact between the free ends 16*a* and the contact areas 22 of the circuit board 20, the contact areas 22 will ideally be coated with gold or tin.

The connecting terminal 10 has an actuating element 17, which can be accessed from the outside of connecting terminal housing 11 through a second hole 13 in said housing 11. The actuating element 17 is designed so that it can move the clamping spring 15*a* of the clamping contact 15 against the elastic force of said clamping spring 15*a* and thereby release the electrical conductor clipped between the clamping spring 15*a* and the clamping contact 15. The electrical conductor can then be withdrawn from the connecting terminal housing 11.

Also positioned on the connecting terminal housing 11 are two snap-in elements 18 by means of which the connecting terminal 10 can be snapped into a housing that is not depicted, to thereby fix the connecting terminal 10 into position. In principle, it would also be possible to position the snap-in elements in such a way that they allow the connecting terminal 10 to be snapped onto the circuit board 20. It is understood that the snap-elements 18 can be positioned on any of the lateral areas, i.e., the front side 11*a*, the back side 11*b*, the upper side 11*c*, the lower side 11*d*, and/or the two lateral sides 11*e* of the connecting terminal housing 11.

A second exemplary embodiment of the invention is shown in FIG. 3. FIG. 3 depicts a connecting terminal 10', which differs only slightly from the connecting terminal 10 shown in FIGS. 1 and 2. Identical components are therefore designated with identical reference numerals. The connecting terminal 10' has a clamping contact 15' with a clamping spring 15*a*'. An electrical conductor, which is not depicted, is again held between the clamping spring 15*a*' and the clamping contact 15'. The connecting terminal 10' has a contact spring 16' which is welded to the clamping contact 15'. The contact spring 16' is also designed as a flat spring, which has an unattached end 16*a*' that is guided through the first hole 12 of the connecting terminal housing 11 and on to the exterior of the connecting terminal housing 11. This free end 16*a*' again has a U-shaped design. The connecting terminal 10' thus differs from the connecting terminal 10 shown in FIGS. 1 and 2 only in the manner in which the contact spring 16' is attached to the clamping contact 15'.

FIGS. 4 and 5 depict a third exemplary embodiment of the invention. FIG. 4 shows four connecting terminals, each of which has a connecting terminal housing 31 with a front side 31*a*, a back side 31*b*, a top side 31*c*, a lower side 31*d*, and two lateral areas 31*e*. The connecting terminals 30 are positioned side by side to form a row.

As can be seen in FIG. 5, the connecting terminal 30 has a clamping contact 35 with a clamping spring 35*a*. An electrical conductor, which is not shown, can be guided through a third hole, which is located on the front side 31*a* of the connecting terminal housing 31 of the connecting terminal 30, into the interior of the connecting terminal housing 31. In the process, it opposes the elastic force of the clamping spring 35*a* and presses the clamping spring 35*a* up to a point such that permits the electrical conductor to be fixed between the clamping spring 35*a* and the clamping contact 35.

Positioned on the clamping contact 35 and forming a single piece with it is a contact spring 36. Here the contact spring 36 is guided to the outside of the connecting terminal housing 31 through a first hole 32 located in the back of the connecting terminal housing 31. The contact spring 36 is designed as a flat spring and has a free end 36*a* which protrudes from the connecting terminal housing 31 through the first hole 32. As in the exemplary embodiment shown in FIG. 1, when the connecting terminal 30 is placed on a circuit board (not depicted), the free end 36*a* of the contact spring 36 will be able to rest against the contact area of the circuit board. To reduce friction between the free end 36*a* of the contact spring 36 and the contact area of the circuit board, the free end 36*a* of the contact spring 36 has a bent shape, specifically a U-shape.

The connecting terminal has an actuating element 37, which is accessible from the outside of the connecting terminal housing via a second hole 33 in the connecting terminal housing 31. The actuating element 37 is designed so that it can move the clamping spring 35*a* of the clamping contact 35 against the elastic force of the clamping spring 35*a* and thereby release an electrical conductor held between the clamping spring 35*a* and the clamping contact 35. The electrical conductor can then be withdrawn from the connecting terminal housing 11.

The first hole 32 is positioned on the back side 31*b* of the connecting terminal housing 31, while the second hole 33 is positioned on the lower side 31*d* of the connecting terminal housing 31. Depending on how the connecting terminal housing 31 is positioned in a housing that is not depicted, it is advantageous for the free end 36*a* of the contact spring 36 to be led out of one of sides 31*a*, 31*b*, 31*c*, 31*d* of the connecting terminal housing 31.

In addition, two snap-in elements 38 are again positioned on the connecting terminal housing 31, and by means of these snap-in element 38 the connecting terminal 30 can be made to engage with a housing that is not depicted, in order to the fix the connecting terminal 30 in position. In principle, it would also be possible to position these snap-in elements 38 so that they could be used to lock the connecting terminal onto the circuit board. The snap-in elements 38 can positioned on any of the lateral areas, i.e., the front side 31*a*, the back side 31*b*, the upper side 31*c*, the lower side 31*d*, and/or two lateral areas 31*e* of the connecting terminal housing 31.

FIGS. 6 and 7 depict a fourth exemplary embodiment of the invention. FIG. 6 shows three connecting terminals 40, each of which has a connecting terminal housing 41 with a front side 41*a*, a back side 41*b*, an upper side 41*c*, a lower side 41*d*, and two lateral areas 41*e*. The connecting terminals 40 are positioned side by side to form a row.

As can be seen in FIG. 7, the connecting terminal 40 has a screw contact 45. Here an actuating element designed as a screw 47 is used to press a clamping spring against an electrical conductor (not depicted) which is led into the interior of the connecting terminal 40 through a third hole 44. The electrical conductor is thus grasped between the screw contact 45 and the clamping spring 45*a* by means of the screw 47. The screw 47 is accessible to operating personnel via a second hole 43, which is positioned in the lower side 41*d* of the connecting terminal housing 41. The screw 47 can be tightened or loosened, depending on whether an electrical conductor is to be held in position or withdrawn from the connecting terminal housing 41.

A contact spring 46 is positioned on the clamping contact 45 so as to form a single piece with. This contact spring 46 is guided through a first hole 42, which is positioned on the lower side 41*d* of the connecting terminal housing 41, to the outside of the connecting terminal housing 41. The contact spring 46 is designed as a flat spring and has a free end 46*a* which protrudes from the connecting terminal housing 41 through the first hole 42. When the connecting terminal 40 is placed on a circuit board, the free end 46*a* of the contact spring 46 creates an electrical contact with the contact areas of the circuit board. To reduce friction between the free end 46*a* of the contact spring 46 and the contact area 22 of the circuit board 20, the free end 46*a* of the contact spring 46 has a bent shape, specifically a U-shape.

Also positioned on the connecting terminal housing 41 are two snap in elements 48 by means of which the connecting terminal 40 can engage with a housing that is not depicted, in order to fix the connecting terminal 40 into position. In principle, it would also be possible to apply the snap-in elements 48 in such a way that they could be used to snap the connecting terminal 40 into position on the circuit board. The snap in elements 48 can be positioned on any of the lateral areas, i.e., the front side 41*a*, the back side 41*b*, the top side 41*c*, the lower side 41*d*, and/or the two lateral areas 41*e* of the connecting terminal housing 41.

FIGS. 8 and 9 show the connecting 10' terminal of FIG. 3 positioned in a housing 50. The housing 50 has a first part 51 and a second part 52. A plurality of connecting terminals 10' are held in position by means of their snap-in elements 18, in a recess 51*b* of the first part 51. Positioned in the second part 52 of the housing 50 is a circuit board 55, which has contact areas on its side facing the connecting terminals 10'. The free ends 16*a*' of the contact springs 16' of the connecting terminals 10' are designed to rest against these contact areas. The feed lines for the connecting terminals 10' are led into the housing 50 through a hole 51*a* in the first part 51, and into the clamping contacts 15' of the connecting terminals 10' through the third holes 14 of the connecting terminals 10', where they are held in position by the clamping spring 15*a*'.

When the second part 52 is placed on the first part 51—as shown in FIG. 9—the connecting terminals 10' and the circuit board 55 are so positioned that the free ends 16' of the connecting terminals 10' come to rest on the corresponding contact areas of the circuit board 55. In addition, the configuration is such that the connecting terminals 10' are pressed against the circuit board 55 with a pressure that is sufficient to insure the seat of the free ends 16*a*' of the contact springs 16' against the contact areas of the circuit board 55. The housing 50 protects the connecting terminals 10' and the circuit board 55 from external influences.

FIG. 10 depicts a fifth exemplary embodiment, with four connecting terminals 60, each of which has a front side 61*a*, a back side, an upper side, a lower side, and two lateral areas 61*e*. Here the four connecting terminals 60 are placed in a row, with their lateral areas 61*e* resting side by side. Positioned on the front side 61*a* is a third hole 64, through which an electrical conductor which is not shown can be guided into the connecting terminal 60. The interior of the connecting terminals 60 may be designed in a fashion analogous to that of the previous exemplary embodiments. As can be seen from FIG. 10, the connecting terminals 60 have an actuating element 67 that may take the form of a pressure element, whose function is comparable to the actuating element 17 of the first exemplary embodiment.

On their outside lateral surfaces 61*e*, the two connecting terminals 60 each have a snap-in element 68 by means of which the row of connecting terminals 60 can be held in position inside a housing, which is not depicted, or on a circuit board, which is also not depicted.

Projecting through an opening (not depicted) in the housing 61 of the connecting terminals 60 is one free end 66*a* of a clamping spring (also not depicted), which is positioned in the connecting terminal 60. This is shown in FIG. 10. In accordance with the basic idea of the invention, therefore, the electrical contact between the connecting terminals 60 and the undepicted circuit board is achieved with the fact the contact springs which are guided through the connecting terminal housing will rest with their free end 66*a* on the corresponding contact surface of the undepicted circuit board as soon as the connecting terminals 60 are properly positioned using the snap-in elements 68.

FIG. 11 show sixth exemplary embodiment involving four connecting terminals 70, each having a connecting terminal housing 71 with a front side 71*a*, a back side, an upper side, a lower side, and two lateral areas 71*e*. The four connecting terminals 70 are arranged in a row, with their lateral areas 71*e* facing each other. Positioned in the front side 71*a* is a third hole 74, through which an undepicted electrical conductor is led into the connecting terminal 70. The interior structure of the connecting terminals 70 may be like that of the preceding exemplary embodiments. As can be seen in FIG. 11, the connecting terminals 70 have an actuating element 77 that, e.g., may take the form of a pressure element, whose function is analogous to that of the actuating element 17 of the first exemplary embodiment.

In contrast to the exemplary embodiment shown in FIG. 10, these connecting terminals 70 may be secured to a housing or on an undepicted circuit board, not through snap-in elements 68, but by means of screw components 78 that are positioned on the outer lateral areas 71*a* of the connecting terminal housing 71.

Projecting through an undepicted opening in the housing 71 of the connecting terminal housing 70 is one free end 76*a* of a clamping spring (not depicted), which is positioned in the connecting terminal 70. This is depicted in FIG. 11. In accordance with the basic idea of the invention, therefore, the electrical contact between the connecting terminals 60 and the undepicted circuit board is achieved with the fact that the contact springs which are guided through the connecting terminal housing will rest with their free end 76*a* on the corresponding contact surface of the undepicted circuit board as soon as the connecting terminals 70 are properly positioned using the screw components 78.

LIST OF REFERENCE NUMERALS

10 connecting terminal
11 connecting terminal housing
11*a* front side
11*b* back side
11*c* upper side
11*d* lower side
11*e* lateral area
12 first hole
13 second hole
14 third hole
15 clamping contact
15*a* clamping spring
16 contact spring
16*a* free end
17 actuating element
18 snap-in element
10' connecting terminal
15' clamping contact
15*a'* clamping spring
16' contact spring
16*a'* free end
20 circuit board
22 contact area
30 connecting terminal
31 connecting terminal housing
31*a* front side
31*b* back side
31*c* upper side
31*d* lower side
31*e* lateral area
32 first hole
33 second hole
35 clamping contact
35*a* clamping spring
36 contact spring
36*a* free end
37 actuating element
38 snap-in element
40 connecting terminal
41 connecting terminal housing
41*a* front side
41*b* back side
41*c* upper side
41*d* lower side
41*e* lateral area
42 first hole
43 second hole
44 third hold
45 screw contact
45*a* clamping spring
46 contact spring
46*a* free end
47 screw
48 snap-in element
50 housing
51 first part
51*a* hole
51*b* recess
52 second part
55 circuit board
60 connecting terminal
61 connecting terminal housing
61*a* front side
61*e* lateral area
64 third hole
66*a* free end
67 actuating element
68 snap-in element
70 connecting terminal
71 connecting terminal housing
71*a* front side
71*e* lateral area
74 third hole
77 actuating element
78 screw element

The invention claimed is:

1. Connecting terminal with an insulating connecting terminal housing and a clamping contact positioned in the connecting terminal housing for the attachment of an electrical conductor, wherein a contact spring, which is connected in electrically conductive fashion to the clamping contact within the connecting terminal housing, is led through an initial hole in the connecting terminal housing to the outside of said housing, and the contact spring is designed so that it presses against a contact area on a circuit board when the connecting terminal is placed on said circuit board, to thereby produce an electrical contact between the circuit board and the clamping contact; and wherein the clamping contact has an integrated actuating element for releasing the clamping contact, such that said actuating element is accessible through, or is guided through, a second hole in the connecting terminal housing, wherein at least one connecting component, specifically at least one snap-in element, is positioned on the connecting terminal housing, to permit the connecting terminal to be mounted on the circuit board and/or to be mounted in a housing.

2. Connecting terminal according to claim 1, wherein the contact spring is connected to the clamping contact to form a single piece with it.

3. Connecting terminal according to claim 1, wherein the contact spring is connected to the clamping contact by means of riveting, welding, soldering, or compression.

4. Connecting terminal according to claim 1, wherein the clamping contact takes the form of a screw contact or an elastic clamping contact.

5. Connecting terminal according to claim 1, wherein the first hole and the second hole lie on the same side of the connecting terminal housing.

6. Connecting terminal according to claim 1, wherein at least one connecting component, specifically at least one screw element, is positioned on the connecting terminal housing to permit the connecting terminal to be mounted on the circuit board and/or to be mounted in a housing.

7. Connecting terminal according to claim 1, wherein the contact spring takes the form of a flat spring.

8. Connecting terminal according to claim 7, wherein the free end of the flat spring is bent, specifically in a U-shaped manner.

9. Housing comprising:

a first and second part; and at least one connecting terminal with an insulating connecting terminal housing and a clamping contact positioned in the connecting terminal housing for the attachment of an electrical conductor; wherein the at least one connecting terminal is positioned in the first part;

a circuit board with at least two contact areas is positioned in the second part; and the connecting terminal is pressed against the circuit board to produce an electrically conductive contact when the first and second parts are joined together.

10. Housing according to claim 9, wherein the first part and the second part are joined together by means of a snap-in connection.

11. Housing according to claim 9, wherein a plurality of connecting terminals is positioned in the first part and a plurality of corresponding contact areas is positioned on the circuit board.

12. Housing according to claim 9, wherein the contact areas on the circuit board are coated with gold or tin.

* * * * *